US009920477B2

(12) United States Patent
Inoue et al.

(10) Patent No.: US 9,920,477 B2
(45) Date of Patent: Mar. 20, 2018

(54) WET PAPER WEB TRANSFER BELT

(71) Applicant: Ichikawa Co., Ltd., Bunkyo-ku (JP)

(72) Inventors: Kenji Inoue, Bunkyo-ku (JP); Ryo Umehara, Bunkyo-ku (JP); Ai Tamura, Bunkyo-ku (JP); Yuta Sugawara, Bunkyo-ku (JP)

(73) Assignee: Ichikawa Co., Ltd., Bunkyo-ku (JP)

( * ) Notice: Subject to any disclaimer, the term of this patent is extended or adjusted under 35 U.S.C. 154(b) by 324 days.

(21) Appl. No.: 14/608,629

(22) Filed: Jan. 29, 2015

(65) Prior Publication Data

US 2015/0218751 A1 Aug. 6, 2015

(30) Foreign Application Priority Data

Feb. 3, 2014 (JP) ..... 2014-030024

(51) Int. Cl.
*D21F 3/02* (2006.01)
*D21F 2/00* (2006.01)
(Continued)

(52) U.S. Cl.
CPC ..... *D21F 1/0027* (2013.01); *D21F 2/00* (2013.01); *D21F 3/0227* (2013.01); *D21F 7/086* (2013.01)

(58) Field of Classification Search
CPC ..... D21F 1/0027; D21F 1/0036; D21F 2/00; D21F 3/0227; D21F 3/0236; D21F 3/029;
(Continued)

(56) References Cited

U.S. PATENT DOCUMENTS 5,298,124 A 3/1994 Eklund et al.
6,331,231 B1 * 12/2001 Inoue ..... B29C 41/28 162/306
(Continued)

FOREIGN PATENT DOCUMENTS

DE 10 2011 080 728 A1 2/2013
EP 1 443 145 A1 8/2004
(Continued)

OTHER PUBLICATIONS

U.S. Appl. No. 14/608,660, filed Jan. 29, 2015, Inoue, et al.

*Primary Examiner* — Eric Hug
(74) *Attorney, Agent, or Firm* — Oblon, McClelland, Maier & Neustadt, L.L.P.

(57) ABSTRACT

The object of the present invention is to reduce the wear of the doctor blade applied to the wet paper web transfer belt and the wear of the guide rolls supporting the wet paper web transfer belt while maintaining the wear resistance of the wet paper web contacting surface and the machine contacting surface of the wet paper web transfer belt together with the adhesive and releasing properties of the wet paper web on the wet paper web contacting surface of conventional wet paper web transfer belts.
This is achieved by a wet paper web transfer belt in which a polyurethane is integrated with a reinforcing base material comprising a wet paper web-side surface and a machine-side surface, at least the wet paper web-side surface of the reinforcing base material is embedded in the polyurethane, an outer circumferential layer comprising a wet paper web contacting surface is constituted by some of the polyurethane; wherein, at least the outer circumferential layer comprises a spherical filler.

11 Claims, 4 Drawing Sheets

(51) Int. Cl.
*D21F 7/08* (2006.01)
*D21F 1/00* (2006.01)

(58) Field of Classification Search
CPC . D21F 7/08; D21F 7/083; D21F 7/086; D21F 7/12; B32B 19/02; B32B 19/06; B32B 27/02; B32B 27/08; B32B 27/12; B32B 27/20; B32B 2305/30
USPC ... 162/306, 358.1, 358.2, 358.3, 358.4, 901; 428/423.1
See application file for complete search history.

(56) References Cited

U.S. PATENT DOCUMENTS

| | | | | |
|---|---|---|---|---|
| 6,962,885 | B1 | 11/2005 | Best | |
| 7,481,907 | B2 * | 1/2009 | Ouchi | D21F 7/083 162/306 |
| 7,517,434 | B2 * | 4/2009 | Ouchi | D21F 7/083 162/306 |
| 2004/0154776 | A1 | 8/2004 | Inoue | |
| 2005/0208288 | A1 | 9/2005 | Li et al. | |
| 2007/0077388 | A1 * | 4/2007 | Westerkamp | D21F 1/0027 428/54 |
| 2008/0081179 | A1 * | 4/2008 | Li | D21F 3/0227 428/332 |
| 2011/0127000 | A1 * | 6/2011 | Yazaki | D21F 3/0227 162/289 |
| 2011/0203758 | A1 | 8/2011 | Yazaki et al. | |
| 2014/0076510 | A1 | 3/2014 | Inoue et al. | |
| 2014/0076511 | A1 | 3/2014 | Inoue et al. | |

FOREIGN PATENT DOCUMENTS

| | | |
|---|---|---|
| EP | 2 581 493 A1 | 4/2013 |
| JP | 6-57678 | 3/1994 |
| JP | 2007-530800 | 11/2007 |
| WO | WO 2005/090429 A1 | 9/2005 |
| WO | WO 2013/020745 A1 | 2/2013 |

* cited by examiner

WET PAPER WEB TRANSFER BELT

TECHNICAL FIELD

The present invention relates to a wet paper web transfer belt (also referred to as transfer belt) used in papermaking machines.

DESCRIPTION OF THE RELATED ART

A papermaking machine for removing moisture from the source material of paper generally comprises a wire part, a press part and a dryer part. The wire part, the press part and the dryer part are arranged along the transfer direction of a wet paper web.

In one type of papermaking machine, the wet paper web is passed from one part to another in an open-draw. In the press part of this open-draw papermaking machine, there are a number of places in which the wet paper web is not supported by any roll or by papermaking equipment such as a felt or a belt; in other words, places in which the wet paper web is travelling on its own. In these places, problems such as "web breaks" tend to occur. The risk of this problem occurring increases as the papermaking machine is operated at high speed; therefore, there are limitations to operating an open-draw papermaking machine at high speed.

In recent years, most papermaking machines have therefore come to be of the type in which the wet paper web is passed in a closed-draw. In the press part of this closed-draw papermaking machine, the wet paper web is transferred while being placed on a papermaking felt or a wet paper web transfer belt; therefore, there are no places in which the wet paper web travels on its own as in an open-draw papermaking machine. As a result, it has become possible to operate papermaking machines at still higher speed and to stabilize operations.

Hereinafter an example of the press part of a closed-draw papermaking machine will be explained in detail. FIG. 8 is a schematic diagram of a closed-draw papermaking machine in which a wet paper web transfer belt according to the present invention is used. As shown in FIG. 8, a closed-draw papermaking machine 2 for removing moisture from a source material of paper comprises a wire part (not shown in the figure), a press part 3 and a dryer part 4. The wire part, the press part 3 and the dryer part 4 are arranged in the order of the processes they perform along the transfer direction of a wet paper web W (the direction indicated by arrow B).

The wet paper web W is transferred by being passed from the wire part to the press part 3 and from there to the dryer part 4. After dewatering the wet paper web in the press part 3, it is finally dried in the dryer part 4. A wet paper web transfer belt 1 is arranged in the press part 3 of the papermaking machine 2 for transferring the wet paper web W in the direction of arrow B.

The wet paper web W is transferred in the direction of arrow B while being supported by press felts 5, 6, the wet paper web transfer belt 1 and a dryer fabric 7, respectively. The press felts 5, 6, the wet paper web transfer belt 1 and the dryer fabric 7 are respectively endless belts supported by guide rollers 8.

In a typical closed-draw papermaking machine, a shoe press mechanism 13 is arranged in a position facing press roll 10. The shoe press mechanism 13 comprises a concave press shoe 9 facing the press roll 10; via a shoe press belt 11, the shoe 9 constitutes a press section 12 together with the press roll 10.

The wet paper web W is passed from the wire part (not shown in the figure) to the press part 3; thereafter, it is passed from the press felt 5 to the press felt 6. Then, the wet paper web W is transferred by the press felt 6 to the press section 12 of the shoe press mechanism 13. In the press section 12, the wet paper web W is compressed by the shoe 9 via the shoe press belt 11 and by the press roll 10 while being sandwiched by the press felt 6 and the wet paper web transfer belt 1. As a result thereof, the moisture in the wet paper web W is dewatered. Compared to the wet paper web transfer belt 1, the press felt 6 is configured to have high water permeability; therefore, in the press section 12, the moisture from the wet paper web W moves to press felt 6. In the press part 3, the wet paper web W is thus dewatered and its surface is smoothened.

Immediately after exiting the press section 12, the wet paper web W, the press felt 6 and the wet paper web transfer belt 1 swell in volume because they are suddenly released from pressure. Due to this swelling and because of the capillary action of the pulp fibers constituting the wet paper web W, the so-called "rewetting phenomenon" occurs in which part of the moisture in the press felt 6 moves to the wet paper web W. Nevertheless, since the water permeability of the wet paper web transfer belt 1 is low, the amount of moisture held inside it is small. Consequently, there is almost no rewetting phenomenon in which moisture moves from the wet paper web transfer belt 1 to the wet paper web W, and the wet paper web transfer belt 1 contributes to improving the dewatering of the wet paper web W.

Having passed through the press section 12, the wet paper web W is transferred by the wet paper web transfer belt 1 in the direction indicated by arrow B. Then, the wet paper web W is sucked up by a suction roll 14 and transferred by the dryer fabric 7 to the dryer part 4, where it is dried.

Here, the adhesive and releasing properties of the wet paper web contacting surface in relation to the wet paper web are among important functions required by the wet paper web transfer belt. In other words, the wet paper web transfer belt 1 requires that the wet paper web W positively adheres to the wet paper web contacting surface of the wet paper web transfer belt 1 immediately after it exits from the press section 12, while allowing the wet paper web W to smoothly release (detach) from the wet paper web transfer belt 1 when it is passed to the dryer fabric. In case these requirements are not fulfilled, the phenomenon of paper robbing can occur.

The phenomenon of paper robbing occurs for example when the adhesive force of the wet paper web contacting surface of the wet paper web transfer belt 1 is weak and the wet paper web W having passed through the press section 12 remains on the press felt 6 instead of being passed from the press felt 6 to the wet paper web transfer belt 1, or when the adhesive force of the wet paper web contacting surface of the wet paper web transfer belt 1 is strong and the wet paper web W remains on the wet paper web transfer belt 1 instead of being passed to the dryer fabric 7.

Further, another important function of the wet paper web transfer belt is the wear resistance of the wet paper web contacting surface and the machine contacting surface of the wet paper web transfer belt. In other words, it becomes possible to use the wet paper web transfer belt over an extended period of time by improving the wear resistance of the wet paper web contacting surface and the machine contacting surface of the wet paper web transfer belt 1.

Various wet paper web transfer belts have been proposed in the prior art to fulfill the above functions.

For example, JP 06-057678 A discloses a wet paper web transfer belt in which a wet paper web contacting surface formed on the upper surface of a base (wet paper web side) is formed by an impermeable polymer coating layer and a lower surface of the base (roll side) is formed by a fibrous web. Particles with a higher hardness than the polymer coating are mixed in the impermeable polymer coating layer and the particles are made to protrude from the surface by such means as polishing the wet paper web contacting surface. Furthermore, U.S. Pat. No. 6,962,885, JP 2007-530800 and WO 2013/020745 similarly propose belts in which various fillers have been added to the resin layer.

As described above, the wet paper web transfer belt 1 is supported by the guide rolls during travelling. Furthermore, by applying a doctor blade to the wet paper web contacting surface of the wet paper web transfer belt 1, pitch and residues from the wet paper web attached to the wet paper web contacting surface of the wet paper web transfer belt 1 are removed, and the moisture profile of the wet paper web contacting surface and the profile of the chemicals (for example releasing agents) distributed on the wet paper web contacting surface become uniform, and the adhesive and releasing properties of the wet paper web with the wet paper web contacting surface (of the wet paper web transfer belt 1) are maintained.

When a wet paper web transfer belt according to the prior art documents is used under such conditions, there is the risk that there is significant wear of the guide rolls and the doctor blade due to the filler added to the resin of the wet paper web transfer belt; therefore, there is a need for an improvement in this respect.

PRIOR ART DOCUMENTS

Patent Document 1: JP 06-057678
Patent Document 2: U.S. Pat. No. 6,962,885
Patent Document 3: JP 2007-530800
Patent Document 4: WO 2013/020745

SUMMARY OF THE INVENTION

Problems to be Solved by the Invention

The object of the present invention is to provide a wet paper web transfer belt, wherein the wear of the doctor blade applied to the wet paper web transfer belt and the wear of the guide rolls supporting the wet paper web transfer belt is reduced, while maintaining the wear resistance of the wet paper web contacting surface and the machine contacting surface of the wet paper web transfer belt together with the adhesive and releasing properties of the wet paper web on the wet paper web contacting surface of conventional wet paper web transfer belts.

Means for Solving the Problems

The present invention, in order to solve the above problems, has employed the technology described below in a wet paper web transfer belt, wherein a reinforcing base material comprising a wet paper web-side surface and a machine-side surface and a water-impermeable resin are integrated with each other, and wherein at least the wet paper web-side surface of the reinforcing base material is embedded in the water-impermeable resin, and an outer circumferential layer comprising a wet paper web contacting surface is constituted by some of the water-impermeable resin.

(1) A wet paper web transfer belt in which a reinforcing base material comprising a wet paper web-side surface and a machine-side surface and a thermosetting polyurethane are integrated with each other, at least the wet paper web-side surface of the reinforcing base material is embedded in the polyurethane, an outer circumferential layer comprising a wet paper web contacting surface is constituted by some of the polyurethane; wherein, at least the outer circumferential layer comprises a spherical filler with a roundness of 0.7 or more.

(2) A wet paper web transfer belt according to (1); wherein the specific surface area of the spherical filler is 10 $m^2/g$ or less.

(3) A wet paper web transfer belt according to (1) to (2); wherein the spherical filler comprises one or more filler(s) selected from inorganic fillers.

(4) A wet paper web transfer belt according to (1) to (3); wherein the spherical filler is only comprised in the outer circumferential layer.

(5) A wet paper web transfer belt according to (1) to (4); wherein the content of the spherical filler is 10 wt % or more in relation to the total weight of the outer circumferential layer (the total weight of the polyurethane, the filler(s) and other additives).

(6) A wet paper web transfer belt according to (1) to (5); wherein the average particle diameter of the spherical filler is 1.0 to 100 μm.

(7) A wet paper web transfer belt according to (1) to (6); wherein two or more types of fillers of different average particle diameter are combined.

(8) A wet paper web transfer belt according to (1) to (7); wherein the reinforcing base material is a composite reinforcing base material in which short fibers have been intertwiningly integrated by needle punching with at least the machine-side surface of the reinforcing base material.

(9) A wet paper web transfer belt according to (8); wherein an inner circumferential layer comprising a machine contacting surface is constituted by some of the short fibers integrated with the machine-side surface.

(10) A wet paper web transfer belt according to (1) to (8); wherein an inner circumferential layer comprising a machine contacting surface is constituted by some of the polyurethane.

By adopting the above-described constitution, the present invention can provide a wet paper web transfer belt, wherein the wear of the doctor blade applied to the wet paper web transfer belt and the wear of the guide rolls supporting the wet paper web transfer belt is reduced, while maintaining the wear resistance of the wet paper web contacting surface and the machine contacting surface of the wet paper web transfer belt together with the adhesive and releasing properties of the wet paper web on the wet paper web contacting surface of conventional wet paper web transfer belts.

BEST MODES FOR CARRYING OUT THE INVENTION

Figure 8:
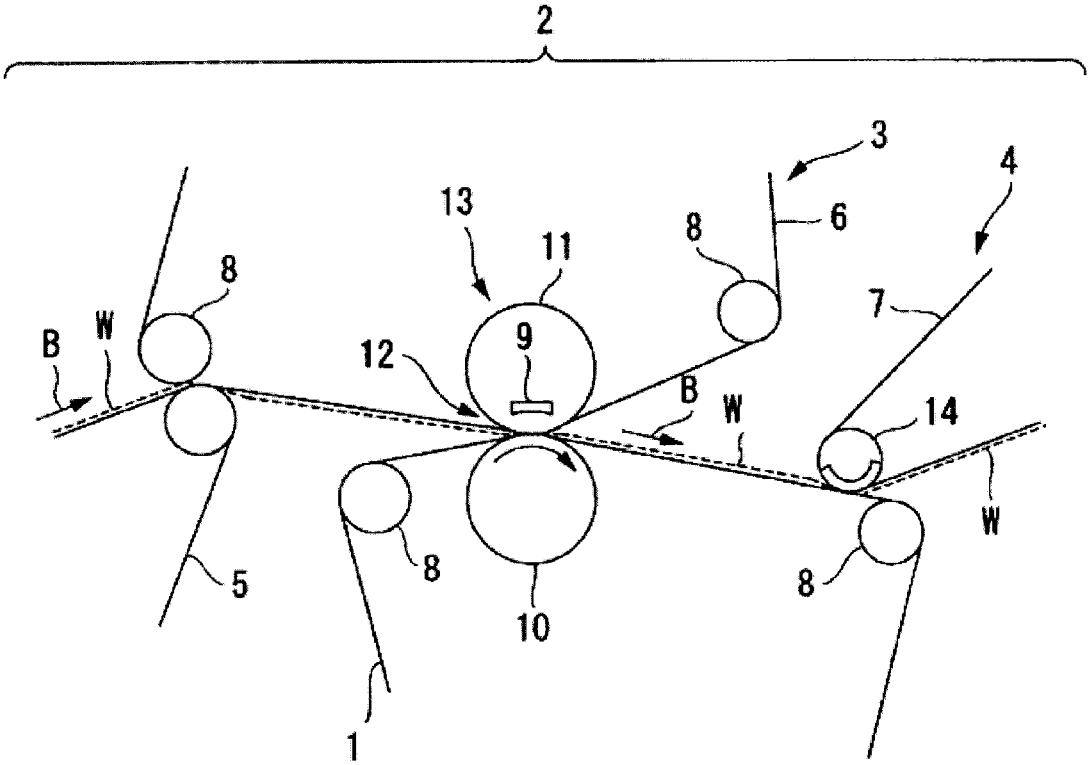
FIG. 8 is a schematic diagram showing an example of the press part of a papermaking machine.

Hereinafter, the embodiments of the present invention will be explained in detail while referring to the drawings. The present invention is a wet paper web transfer belt 1 used in the press part of the papermaking machine shown in FIG. 8. The wet paper web transfer belt 1 is an endless belt supported by guide rollers 8.

Figure 1:
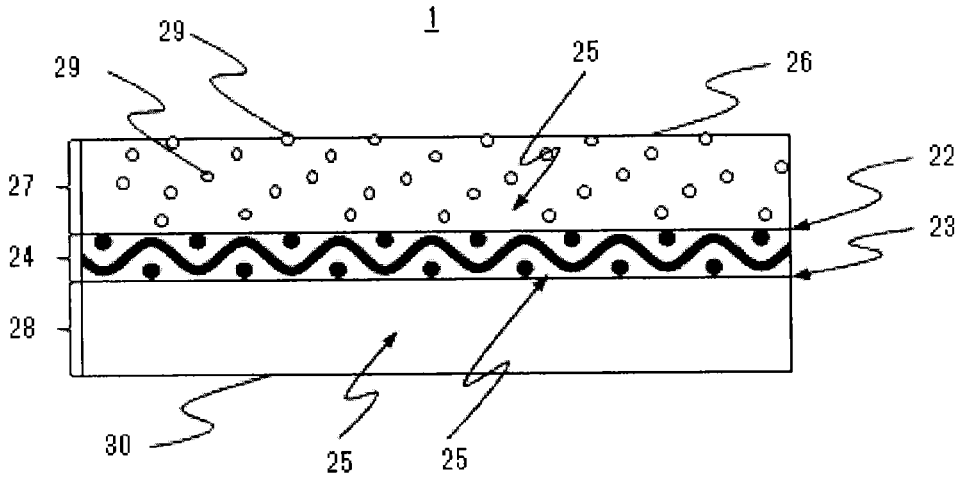
FIG. 1 is a sectional view showing a wet paper web transfer belt according to the present invention.

FIG. 1 is a sectional view in the width direction (in the Cross Machine Direction: CMD) of the wet paper web transfer belt 1 according to the present invention. The wet paper web transfer belt 1 is constituted by integrating a reinforcing base material 24 and a polyurethane 25 by impregnating with the polyurethane 25 and by layering and curing the polyurethane 25 so that the reinforcing base material 24 comprising a wet paper web-side surface 22 and a machine-side surface 23 is embedded in the thermosetting polyurethane 25, and so that an outer circumferential layer 27 comprising a wet paper web contacting surface 26 and an inner circumferential layer 28 comprising a machine contacting surface 30 are formed by some of the water-impermeable resin 25. A spherical filler 29 is included in the polyurethane 25 constituting the outer circumferential layer 27.

Figure 2:
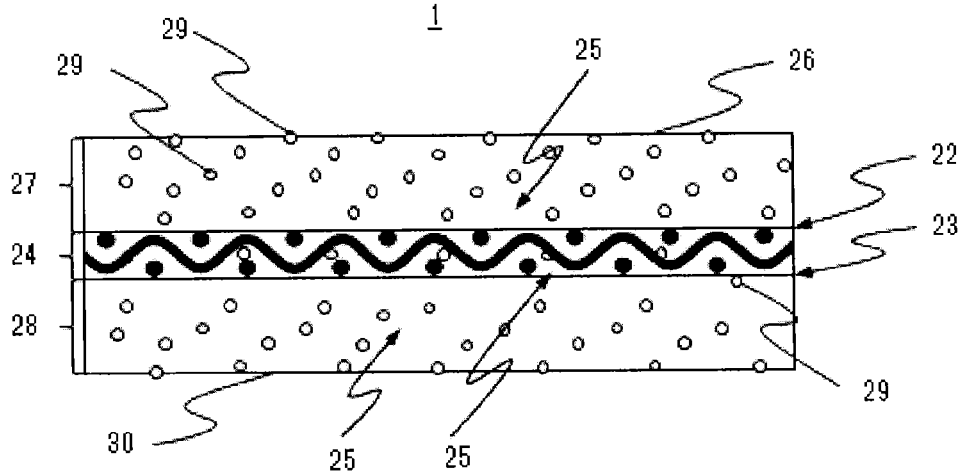
FIG. 2 is a sectional view showing another embodiment of a wet paper web transfer belt according to the present invention.

FIGS. 2 to 6 are sectional views in the width direction showing another embodiment of the wet paper web transfer belt 1 according to the present invention. A wet paper web transfer belt 1 shown in FIG. 2 is constituted by integrating a reinforcing base material 24 and a polyurethane 25 by impregnating with the polyurethane 25 and by layering and curing the polyurethane 25 so that the reinforcing base material 24 comprising a wet paper web-side surface 22 and a machine-side surface 23 is embedded in the polyurethane 25, and so that an outer circumferential layer 27 comprising a wet paper web contacting surface 26 and an inner circumferential layer 28 comprising a machine contacting surface 30 are formed by some of the polyurethane 25. A spherical filler 29 is included in the polyurethane 25 constituting the outer circumferential layer 27 and the inner circumferential layer 28 and the polyurethane 25 impregnating the reinforcing base material 24. In this way, due to the filler contained in the inner circumferential layer 28, it is possible to improve the wear resistance of the machine contacting surface 30 while also improving the crack resistance of the polyurethane.

Figure 3:
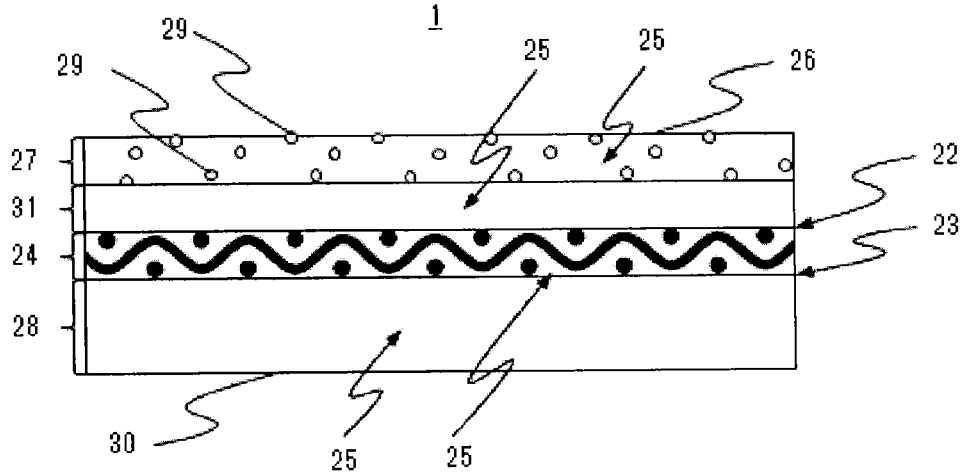
FIG. 3 is a sectional view showing another embodiment of a wet paper web transfer belt according to the present invention.

A wet paper web transfer belt 1 shown in FIG. 3 is constituted by integrating a reinforcing base material 24 and a polyurethane 25 by impregnating with the polyurethane 25 and by layering and curing the polyurethane 25 so that the reinforcing base material 24 comprising a wet paper web-side surface 22 and a machine-side surface 23 is embedded in the polyurethane 25, and so that an outer circumferential layer 27 comprising a wet paper web contacting surface 26, an intermediate layer 31 formed between the outer circumferential layer 27 and the wet paper web contacting surface 22 of the reinforcing base material 24, and an inner circumferential layer 28 comprising a machine contacting surface 30 are formed by some of the polyurethane 25. A spherical filler 29 is included in the polyurethane 25 constituting the outer circumferential layer 27. In this way, it is possible to prevent the wear of the reinforcing base material 24 due to a filler by not including a filler in the polyurethane 25 impregnating the reinforcing base material 24, the inner circumferential layer 28 and the intermediate layer 31 adjacent to the reinforcing base material 24.

Figure 4:
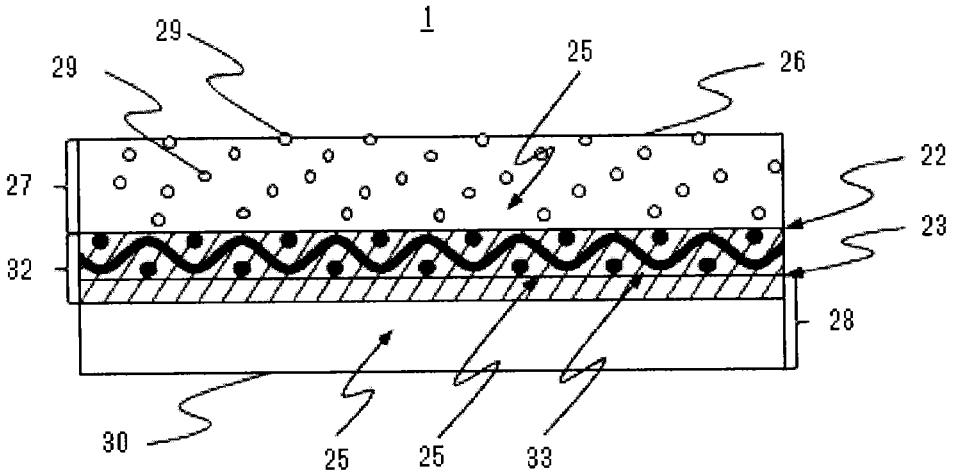
FIG. 4 is a sectional view showing another embodiment of a wet paper web transfer belt according to the present invention.

A wet paper web transfer belt 1 shown in FIG. 4 is constituted by integrating a composite reinforcing base material 32, in which short fibers 33 have been intertwiningly integrated by needle punching in a machine-side surface 23 of a reinforcing base material 24 comprising a wet paper web-side surface 22 and a machine-side surface 23, and a polyurethane 25 by impregnating with the polyurethane 25 and by layering and curing the polyurethane 25 so that the composite reinforcing base material 32 is embedded in the polyurethane 25, and so that an outer circumferential layer 27 comprising a wet paper web contacting surface 26 and an inner circumferential layer 28 comprising a machine contacting surface 30 are formed by some of the polyurethane 25. A spherical filler 29 is included in the polyurethane 25 constituting the outer circumferential layer 27. In this way, by using the composite reinforcing base material 32, it is possible to improve the strength of the wet paper web transfer belt, adjust the impregnation speed of the polyurethane during manufacturing and also improve operability.

Figure 5:
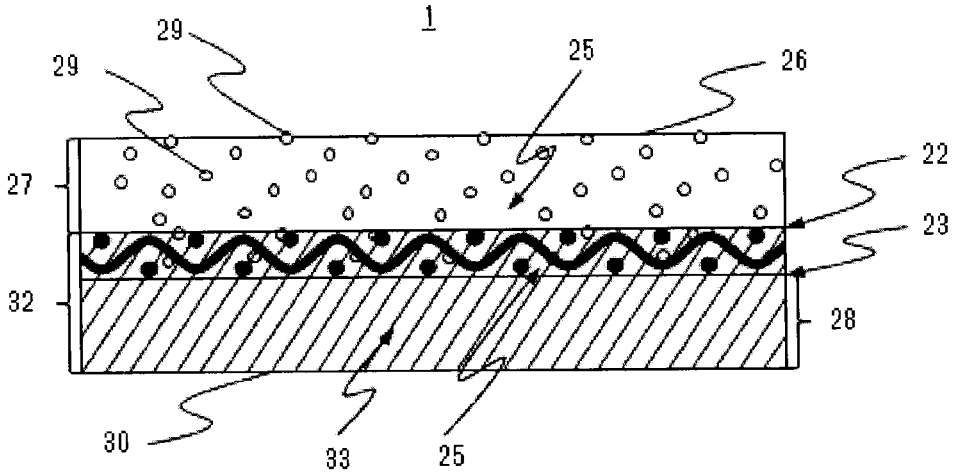
FIG. 5 is a sectional view showing another embodiment of a wet paper web transfer belt according to the present invention.

A wet paper web transfer belt 1 shown in FIG. 5 is constituted by integrating a composite reinforcing base material 32, in which short fibers 33 have been intertwiningly integrated by needle punching in a machine-side surface 23 of a reinforcing base material 24 comprising a wet paper web-side surface 22 and a machine-side surface 23, and a polyurethane 25 by impregnating with the polyurethane 25 and by layering and curing the polyurethane 25 so that at least the wet paper web-side surface 22 of the composite reinforcing base material 32 is embedded in the polyurethane 25, and so that an outer circumferential layer 27 comprising a wet paper web contacting surface 26 is formed by some of the polyurethane 25, and the inner circumferential layer 28 comprising a machine contacting surface 30 is formed by some of the short fibers 33. A spherical filler 29 is included in the polyurethane 25 constituting the outer circumferential layer 27. In this way, due to the use of short fibers in the inner circumferential layer 28, the flexibility of the wet paper web transfer belt is improved; the installation of the belt in a papermaking machine is made easy, while the wear of the guide rollers 8 is reduced.

Figure 6:
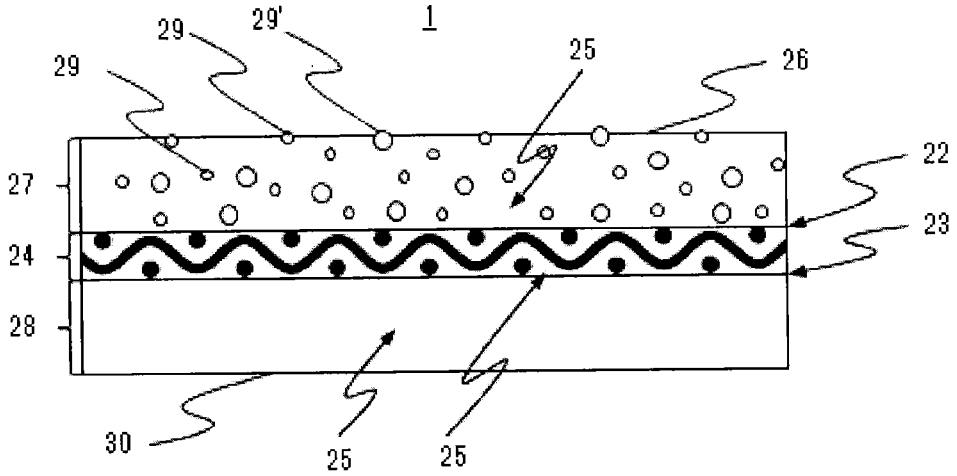
FIG. 6 is a sectional view showing another embodiment of a wet paper web transfer belt according to the present invention.

A wet paper web transfer belt 1 shown in FIG. 6 is constituted by integrating a reinforcing base material 24 and a polyurethane 25 by impregnating with the polyurethane 25 and by layering and curing the polyurethane 25 so that the reinforcing base material 24 comprising a wet paper web-side surface 22 and a machine-side surface 23 is embedded in the polyurethane 25, and so that an outer circumferential layer 27 comprising a wet paper web contacting surface 26 and an inner circumferential layer 28 comprising a machine contacting surface 30 are formed by some of the polyurethane 25. Two types of spherical fillers 29, 29' of different average particle diameter are included in the polyurethane 25 constituting the outer circumferential layer 27. In this way, by including two or more types of a spherical filler of different average particle size in the outer circumferential layer 27, it is possible to adjust with greater accuracy the surface wear properties and the wear of the doctor blade and the guide rolls together with the adhesive and releasing properties of the wet paper web on the wet paper web contacting surface 26.

The reinforcing base material 24 is generally a fabric woven with a weaving machine, or the like, from warp and weft yarns; however, a grid-like structure made by superposing warp and weft columns can also be used.

Examples of materials for the reinforcing base material 24 and the short fibers 33 include polyester (polyethylene terephthalate, polybutylene terephthalate, and the like), aliphatic polyamide (polyamide 11, polyamide 12, polyamide 612, and the like), aromatic polyamide (aramid), polyvinylidene fluoride, polypropylene, polyether ether ketone, polytetrafluoroethylene, polyethylene, wool, cotton, metal, and the like.

Examples of alternative materials for the polyurethane 25 include thermosetting resins such as epoxy, acrylic, and the like, or thermoplastic resins such as polyamide, polyarylate, polyester, and the like; preferably urethane resin is used.

The roundness (X) of the filler particles can be expressed by formula (1) below; wherein, A and C are respectively the particle projected area and the perimeter measured on an image taken of a filler particle by an electron microscope, B is the area of a perfect circle corresponding to the perimeter C, r is the particle radius, and π is the circular constant.

$$X=A/B=A/(\pi r^2)=A/\{\pi\times(C/2\pi)^2\}=A\times/C^2 \quad (1)$$

The fillers 29, 29' according to the present invention have a roundness of 0.7 or more.

Examples of materials for the spherical fillers 29, 29' include inorganic fillers such as silica, glass, calcium carbonate, iron, stainless steel, alumina, aluminum, zinc, tin, titanium and the like. The average particle diameter of the spherical fillers 29, 29' can be in the range from 1.0 μm to 100 μm. The specific surface area of the spherical filler 29 can be 10 $m^2/g$ or less.

The amount of spherical filler varies according to the type of paper to be made and according to the papermaking conditions; however, in order to ensure the sheet adhesion properties, it is preferred to introduce, into the outer circumferential layer 27, 10 wt % or more of the filler in relation to at least the total weight of the outer circumferential layer (the total weight of the polyurethane, the filler(s) and other additives). Moreover, in order to prevent contamination in parts where lipophilic contaminants (from pitch, sizing agents, and the like) are abundant, it is necessary to make the surface hydrophilic by introducing a relatively large amount of filler; however, if the amount of spherical filler exceeds 60% of the total weight (the total weight of the polyurethane, the filler(s) and other additives), the wet paper web transfer belt becomes too hard and there is the risk of cracks occurring. Further, in parts where fine pulp fibers with high adhesiveness are used, there is the risk of malfunctioning occurring in which the fine pulp fibers adhere to the surface of the wet paper web transfer belt if too much filler is introduced. Consequently, the total amount of the spherical fillers 29, 29' in each layer is preferably 10 wt % to 60 wt % of the total weight of the layer (the total weight of the polyurethane, the fillers and other additives). Other additives such as pigments and anti-foaming agents can be appropriately added according to design.

Thus, by adopting the above-described constitution in the wet paper web transfer belt 1, it is possible to reduce the wear of the guide rolls supporting the wet paper web transfer belt and the wear of the doctor blade applied to the wet paper web transfer belt, while maintaining the adhesive and releasing properties of the wet paper web on the wet paper web contacting surface of conventional wet paper web transfer belts together with the wear resistance of the wet paper web contacting surface and the machine contacting surface of the wet paper web transfer belt.

Hereinafter, a specific example of a production method of a wet paper web transfer belt according to the present invention will be explained.

Figure 7:
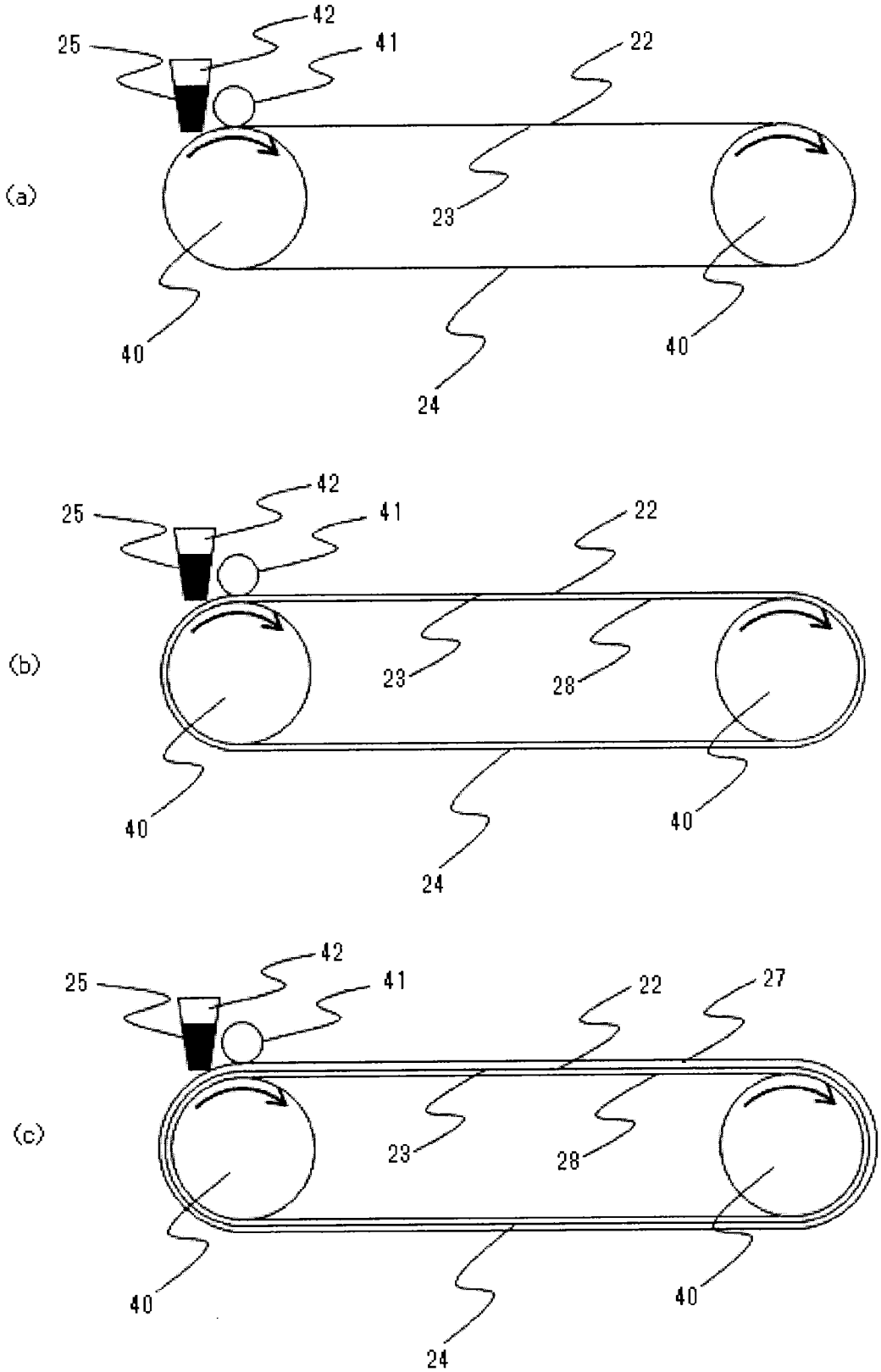
FIG. 7 are schematic diagrams showing a method for impregnating and layering a wet paper web transfer belt according to the present invention with polyurethane.

FIG. 7 is a schematic diagram showing the layering of polyurethane of the wet paper web transfer belt 1 shown in FIG. 1. As shown in FIG. 7 (*a*), the reinforcing base material 24 is installed so that the machine-side surface 23 of the reinforcing base material 24 is in contact with the rolls 40, which are arranged in parallel. Then, the inner circumferential layer 28 of the wet paper web transfer belt 1 can be formed by coating polyurethane from a resin discharge opening 42 onto the wet paper web-side surface 22 of the reinforcing base material 24 while rotating the rolls 40, and by allowing the polyurethane to penetrate by a coater bar 41 from the wet paper web-side surface 22 of the reinforcing base material 24 to the machine-side surface 23 thereof and by curing the polyurethane (FIG. 7 (*b*)). The semi-finished product obtained in this step is installed so that the wet paper web-side surface 22 of the reinforcing base material 24 is in contact with the two rolls 40, which are arranged in parallel; then, the inner circumferential layer 28 of the wet paper web transfer belt 1 can be formed by coating polyurethane from the resin discharge opening 42 onto the machine-side surface 23 of the reinforcing base material 24 while rotating the rolls 40, and by layering the polyurethane onto the machine-side surface 23 of the reinforcing base material 24 by the coater bar 41 and by curing the polyurethane; it is also possible to perform this process by inversing the front and the back.

Next, the outer circumferential layer 27 of the wet paper web transfer belt 1 can be formed by again coating polyurethane from the resin discharge opening 42 onto the wet paper web-side surface 22 of the reinforcing base material 24 while rotating the rolls 40, and by layering the polyurethane by the coater bar 41 and by curing the polyurethane (FIG. 7 (*c*)). Now, the wet paper web transfer belt 1 shown in FIG. 1 can be obtained by including the spherical filler 29 in the polyurethane constituting the outer circumferential layer 27. Further, the wet paper web contacting surface 26 and the machine contacting surface 30 of the wet paper web transfer belt 1 can be polished according to need and the desired surface roughness can be obtained.

Moreover, the wet paper web transfer belts 1 shown in FIGS. 2 to 6 can be obtained by optionally setting the use of a polyurethane comprising the spherical fillers 29, 29', the constitution of the intermediate layer 31 not comprising the spherical fillers 29, 29', and the use of the composite reinforcing base material 32 as substitute for the reinforcing base material 24.

Hereinafter, the present invention will be described by means of the Examples and Comparative Examples.

The Reinforcing Base Material

The reinforcing base materials of the wet paper web transfer belts according to Examples 1 to 6 and Comparative Examples 1 to 3 used the following constitution.

Upper warp yarn: twisted monofilament of 2000 dtex made from polyamide 6

Lower warp yarn: twisted monofilament of 2000 dtex made from polyamide 6

Weft yarn: twisted monofilament of 1400 dtex made from polyamide 6

Weave: double warp weave of 40 upper/lower warp yarns/5 cm and 40 weft yarns/5 cm The Polyurethane The polyurethane of the wet paper web transfer belts of Examples 1 to 6 and Comparative Examples 1 to 3 was obtained by reacting a mixture of tolylenediisocyanate (TDI) and polytetramethylene glycol (PTMG), as urethane prepolymer, with dimethylthiotoluenediamine (DMTDA), as curing agent.

In Examples 1 to 6, the wet paper web transfer belt shown in FIG. 1 was obtained by using the above-described reinforcing base material and polyurethane. Moreover, in Comparative Examples 1 to 3, the wet paper web transfer belt was produced by changing the filler shown in FIG. 1. The polyurethane curing conditions were identical for all wet paper web transfer belts; after curing the polyurethane, the wet paper web contacting surface was polished and the surface roughness Ra (arithmetic average surface roughness) of the wet paper web contacting surface was fixed at 3 μm for all belts.

The conditions of the spherical fillers included in the outer circumferential layer of the wet paper web transfer belts of Examples 1 to 6 and the conditions of the fillers included in the outer circumferential layer of Comparative Examples 1 to 3 are shown in Table 1.

Figure 9:
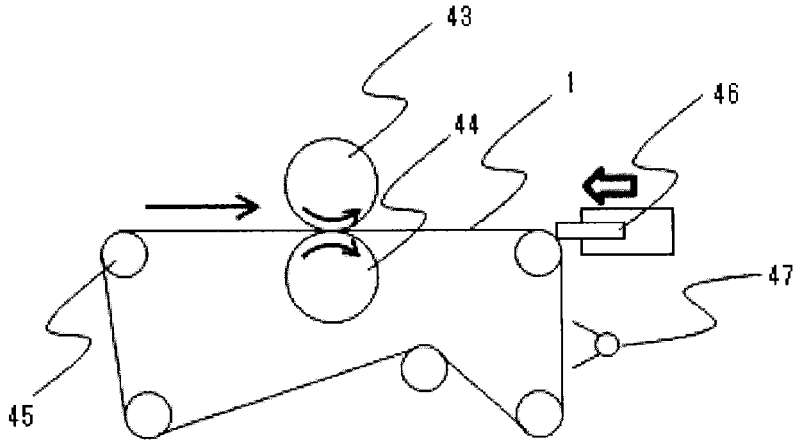
FIG. 9 is a schematic diagram relating to a test device for evaluating wear.

High-density polyethylene bar wear tests were carried out with the wet paper web transfer belts of Examples 1 to 6 and Comparative Examples 1 to 3 by using the device shown in FIG. 9. The amount of wear of the high-density polyethylene bars was evaluated by the weight loss of the high-density polyethylene bar and the samples were indexed by using the amount of wear of Comparative Example 3 as 100. The tests were carried out at a test speed of the device of 1400 m/min, a test duration of 12 hours, and a pushing pressure of 300 N/m of a square high-density polyethylene bar of 20 mm×20 mm. The evaluated results of the wear test are shown in Table 1.

TABLE 1

| | Filler | | | | Wear | |
|---|---|---|---|---|---|---|
| | Material | Roundness | Average particle diameter (μm) | Amount (wt %) | Wear index | Percentage of Comparative Examples (%) |
| Example 1 | Silica | 0.7 | 2.5 | 60 | 86 | 28-86 |
| Example 2 | Silica | 0.7 | 2.5 | 30 | 60 | 19-60 |
| Example 3 | Silica | 0.7 | 2.5 | 10 | 22 | 7.1-22 |
| Example 4 | Silica | 0.7 | 1.0 | 10 | 23 | 7.4-23 |
| Example 5 | Silica | 0.7 | 100 | 10 | 24 | 7.7-24 |
| Example 6 | Silica | 0.7 | 2.5:25 = 1:1 | 10 | 24 | 7.7-24 |
| Comparative Example 1 | Silica | 0.6 | 2.5 | 60 | 310 | — |
| Comparative Example 2 | Silica | 0.6 | 2.5 | 30 | 193 | — |
| Comparative Example 3 | Silica | 0.6 | 2.5 | 10 | 100 | — |

As shown in Table 1, the wet paper web transfer belts of Examples 1 to 6 are transfer belts which can reduce the wear of a member brought into contact with the surface thereof and which reduce the wear of the doctor blade.

EXPLANATION OF THE REFERENCE CHARACTERS

W: wet paper web, 1: wet paper web transfer belt, 2: closed-draw papermaking machine, 3: press part, 4: dryer part, 5, 6: press felt, 7: dryer fabric, 8: guide rolls, 9: shoe, 10: press roll, 11: shoe press belt, 12: press section, 13: shoe press mechanism, 14: suction roll, 22: wet paper web-side surface, 23: machine-side surface, 24: reinforcing base material, 25: polyurethane, 26: wet paper web contacting surface, 27: outer circumferential layer, 28: inner circumferential layer, 29, 29': spherical filler, 30: machine contacting surface, 31: intermediate layer, 32: composite reinforcing base material, 33: short fibers, 40: rolls, 41: coater bar, 42: resin discharge opening, 43: top roll, 44: bottom roll, 45: guide rolls, 46: high-density polyethylene bar, 47: shower

The invention claimed is:

1. A wet paper web transfer belt in which a reinforcing base material comprising a wet paper web-side surface and a machine-side surface and a thermosetting polyurethane are integrated with each other, at least the wet paper web-side surface of the reinforcing base material is embedded in the polyurethane, an outer circumferential layer comprising a wet paper web contacting surface is constituted by some of the polyurethane;

wherein at least the outer circumferential layer comprises a spherical filler having a roundness of 0.7 or more, and the spherical filler comprising a plurality of spherical fillers selected from inorganic fillers.

2. The wet paper web transfer belt according to claim 1, wherein the specific surface area of the spherical filler is 10 $m^2/g$ or less.

3. The wet paper web transfer belt according to claim 1, wherein the spherical filler is only comprised in the outer circumferential layer.

4. The wet paper web transfer belt according to claim 1, wherein the content of the spherical filler is 10 wt % or more in relation to the total weight of the outer circumferential layer (the total weight of the polyurethane, the filler(s) and other additives).

5. The wet paper web transfer belt according to claim 1, wherein an average particle diameter of the spherical filler is 1.0 to 100 μm.

6. The wet paper web transfer belt according to claim 1, wherein two or more types of fillers of different average particle diameter are combined.

7. The wet paper web transfer belt according to claim 1, wherein the reinforcing base material is a composite reinforcing base material in which short fibers have been intertwiningly integrated by needle punching with at least the machine-side surface of the reinforcing base material.

8. The wet paper web transfer belt according to claim 7, wherein an inner circumferential layer comprising a machine contacting surface is constituted by some of the short fibers integrated with the machine-side surface.

9. The wet paper web transfer belt according to claim 1, wherein an inner circumferential layer comprising a machine contacting surface is constituted by some of the polyurethane.

10. A wet paper web transfer belt in which a reinforcing base material comprising a wet paper web-side surface and a machine-side surface and a thermosetting polyurethane are integrated with each other, at least the wet paper web-side surface of the reinforcing base material is embedded in the polyurethane, an outer circumferential layer comprising a wet paper web contacting surface is constituted by some of the polyurethane;

wherein at least the outer circumferential layer comprises a spherical filler having a roundness of 0.7 or more, and wherein the specific surface area of the spherical filler is 10 $m^2/g$ or less.

11. A wet paper web transfer belt in which a reinforcing base material comprising a wet paper web-side surface and a machine-side surface and a thermosetting polyurethane are integrated with each other, at least the wet paper web-side surface of the reinforcing base material is embedded in the polyurethane, an outer circumferential layer comprising a wet paper web contacting surface is constituted by some of the polyurethane;

wherein at least the outer circumferential layer comprises a spherical filler having a roundness of 0.7 or more, and wherein two or more types of fillers of different average particle diameter are combined.

* * * * *